US006662990B1

(12) United States Patent
Sun

(10) Patent No.: US 6,662,990 B1
(45) Date of Patent: Dec. 16, 2003

(54) BUFFER APPARATUS OF ELECTRICAL NAILING GUN

(75) Inventor: Pei-Chang Sun, Taichung (TW)

(73) Assignees: Modern Pioneer Ltd., Taichung (TW); Pei-Chang Sun, Taichung (TW)

( * ) Notice: Subject to any disclaimer, the term of this patent is extended or adjusted under 35 U.S.C. 154(b) by 15 days.

(21) Appl. No.: 10/335,887

(22) Filed: Jan. 3, 2003

(51) Int. Cl.[7] ..... B25C 1/04
(52) U.S. Cl. ..... 227/131; 173/210; 227/130
(58) Field of Search ..... 227/131, 132, 227/130, 10; 173/210, 211, 212

(56) References Cited

U.S. PATENT DOCUMENTS 4,305,541 A * 12/1981 Barrett et al. ..... 227/131
4,515,303 A * 5/1985 Schadlich et al. ..... 227/131
4,565,313 A * 1/1986 Buck et al. ..... 227/131
4,573,621 A * 3/1986 Merkator et al. ..... 227/131
4,867,366 A * 9/1989 Kleinholz ..... 227/130
5,437,339 A * 8/1995 Tanaka ..... 173/210
6,364,193 B1 * 4/2002 Tsai ..... 227/131

* cited by examiner

*Primary Examiner*—Scott A. Smith
(74) *Attorney, Agent, or Firm*—Browdy and Neimark, P.L.L.C.

(57) ABSTRACT

A buffer apparatus of a nailing gun, which controls the air flow in and out a chamber of a main body of the nailing gun, reduces the vibration of the nailing gun when nailing. The air will flow in with a larger rate and will flow out with a smaller rate, such that a buffer force will be provided to a bar being punched to reduce the vibration, and more particularly, the air flow also can bring the heat out.

7 Claims, 4 Drawing Sheets

BUFFER APPARATUS OF ELECTRICAL NAILING GUN

BACKGROUND OF THE INVENTION

1. Field of the Invention

The present invention relates to a nailing gun, and more particularly to a composite a buffer apparatus of an electrical nailing gun.

2. Description of the Related Art

FIG. 1 shows a conventional nailing gun, comprising a main body 1, a nail outlet 2, a nail magazine 3, a coil 4, a bar 5 and a spring 6. The bar 5 passes through the coil 4 and rests a front end thereof in the nail outlet 2 for punching nails (not shown). The bar 5 is provided with a stop flange 5*a* at a rear end thereof and the spring 6 is installed on the bar 5 having an end thereof against the stop flange 5*a* and the other end thereof against the coil 4. While adding electricity to the coil 4 will generate magnetic force to drive the bar 5 punching out and make the spring 6 compressed as shown in FIG. 1, and while cut the power off, the magnetic force provided by the coil 4 will be gone and the spring 6 will drive the bar 5 back in the main body 1 as shown in FIG. 2.

It will cause the nailing gun a large vibration when the punched-out bar 5 is drawn back by the spring 6 and crashes on the sidewall of the main body 1. It sometime will affect nailing, or damage the sidewall of the main body 1, or make the bar 5 deviating. Some conventional nailing guns were provided with a buffer block (not shown) therein to absorb the vibration, but the buffer block will loose the absorbing capacity after a long time of use. The buffer block sometime will escape from its original position, at this time, it will affect the bar 5 acting.

In addition, the coil will rise its temperature after a long time use and there still is no perfect solution for this problem.

SUMMARY OF THE INVENTION

The primary objective of the present invention is to provide a buffer apparatus of a nailing gun, which use air flow to provide the buffer capacity.

The secondary objective of the present invention is to provide a buffer apparatus of a nailing gun, which can dissipate the heat of coil.

According to the objectives of the present invention, it provides a buffer apparatus of a nailing gun, wherein the nailing gun comprises a main body, a coil and a bar. The main body has a nail outlet, a chamber therein and a through hole communicating the chamber to outside. The coil is provided in the chamber and the bar is movably provided in the chamber, which passes through the coil and corresponds to the nail outlet. A sealing member, which is a flexible piece, is provided in the chamber of the main body and secured to the bar, wherein the sealing member is against a sidewall of the chamber when extended. A returning member is provided at between the sealing member and the coil, and an adjusting member is provided in the chamber of the main body having a stop face and an aperture, wherein the adjusting member has an end thereof pivoted on the sidewall of the chamber to make the stop face sheltered and unsheltered the through hole and the aperture corresponds to the through hole which has a size smaller than the through hole.

DETAILED DESCRIPTION OF THE INVENTION

Figure 1:
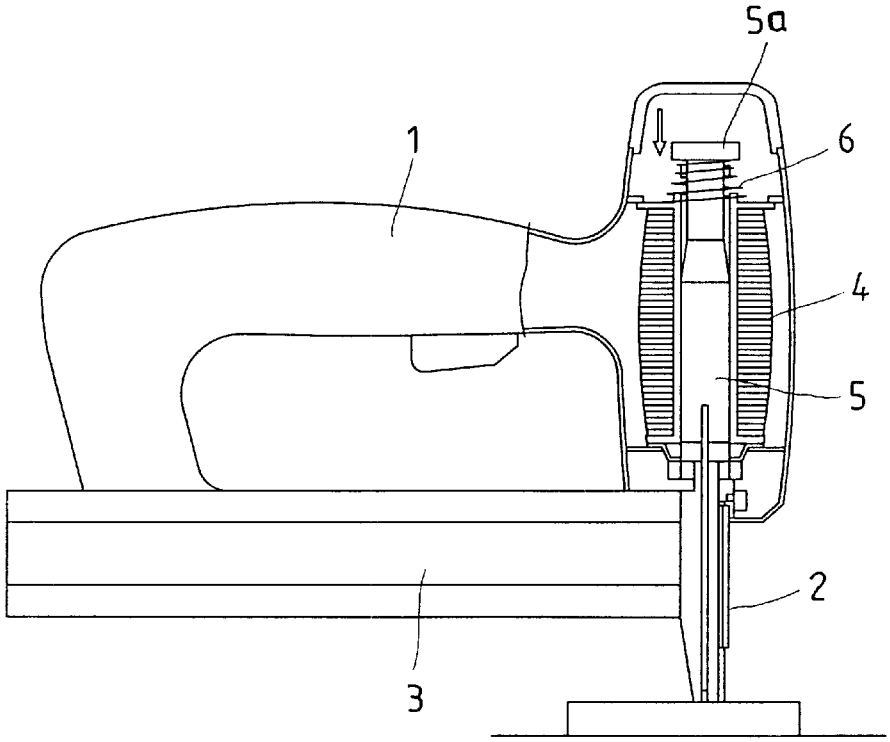
FIG. 1 PRIOR ART
FIG. 1 is a schematic view of a conventional nailing gun, showing a bar punched out.
Figure 2:
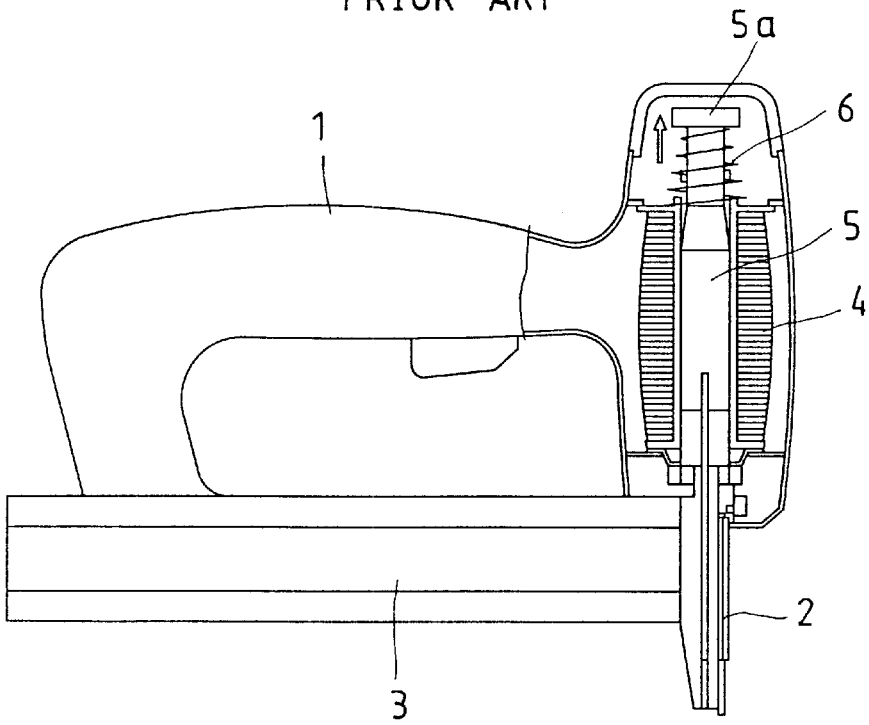
FIG. 2 PRIOR ART
FIG. 2 is a schematic view of the conventional nailing gun, showing the bar drawn back.
Figure 3:
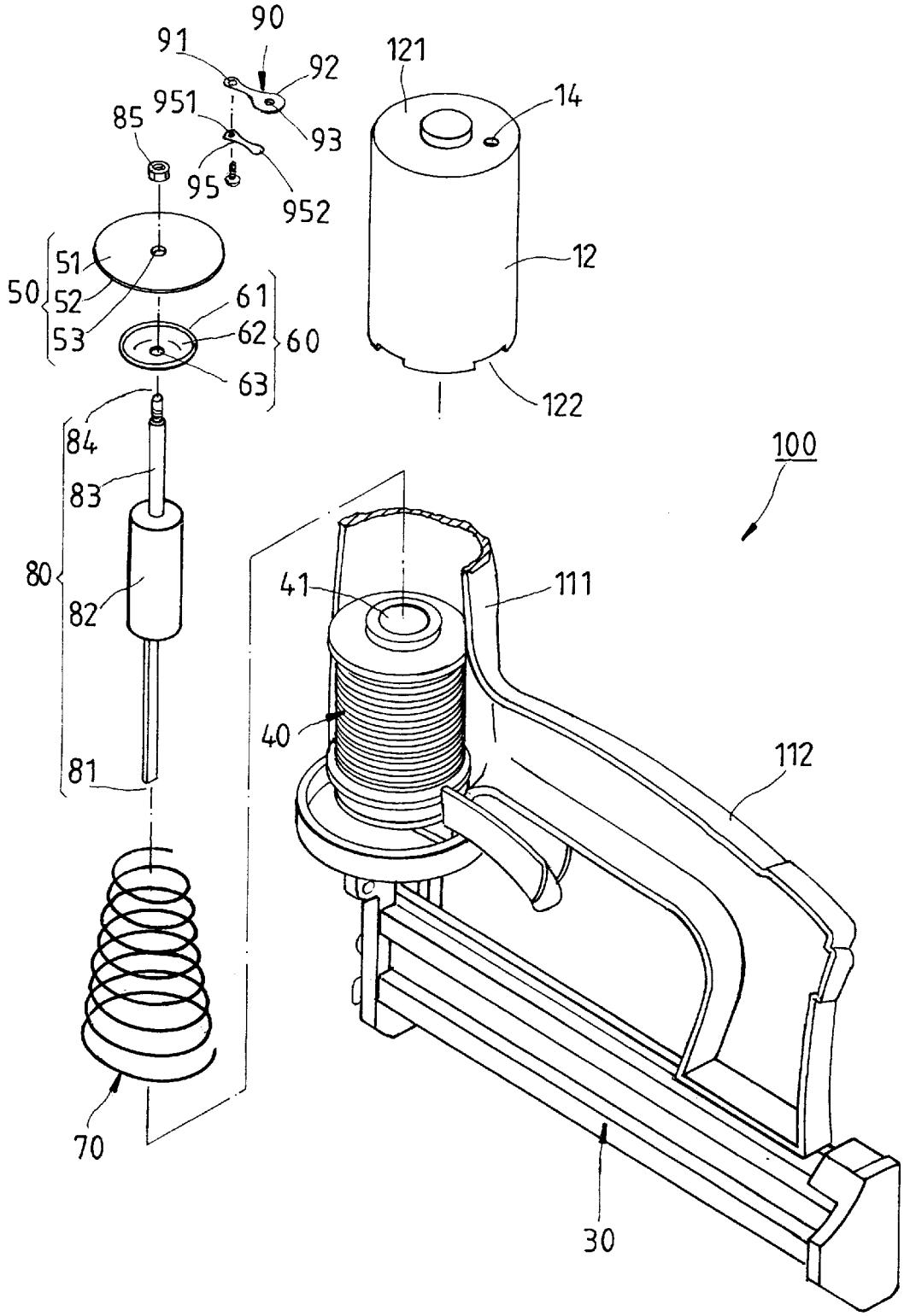
FIG. 3 an exploded view of a preferred embodiment of the present invention.
Figure 4:
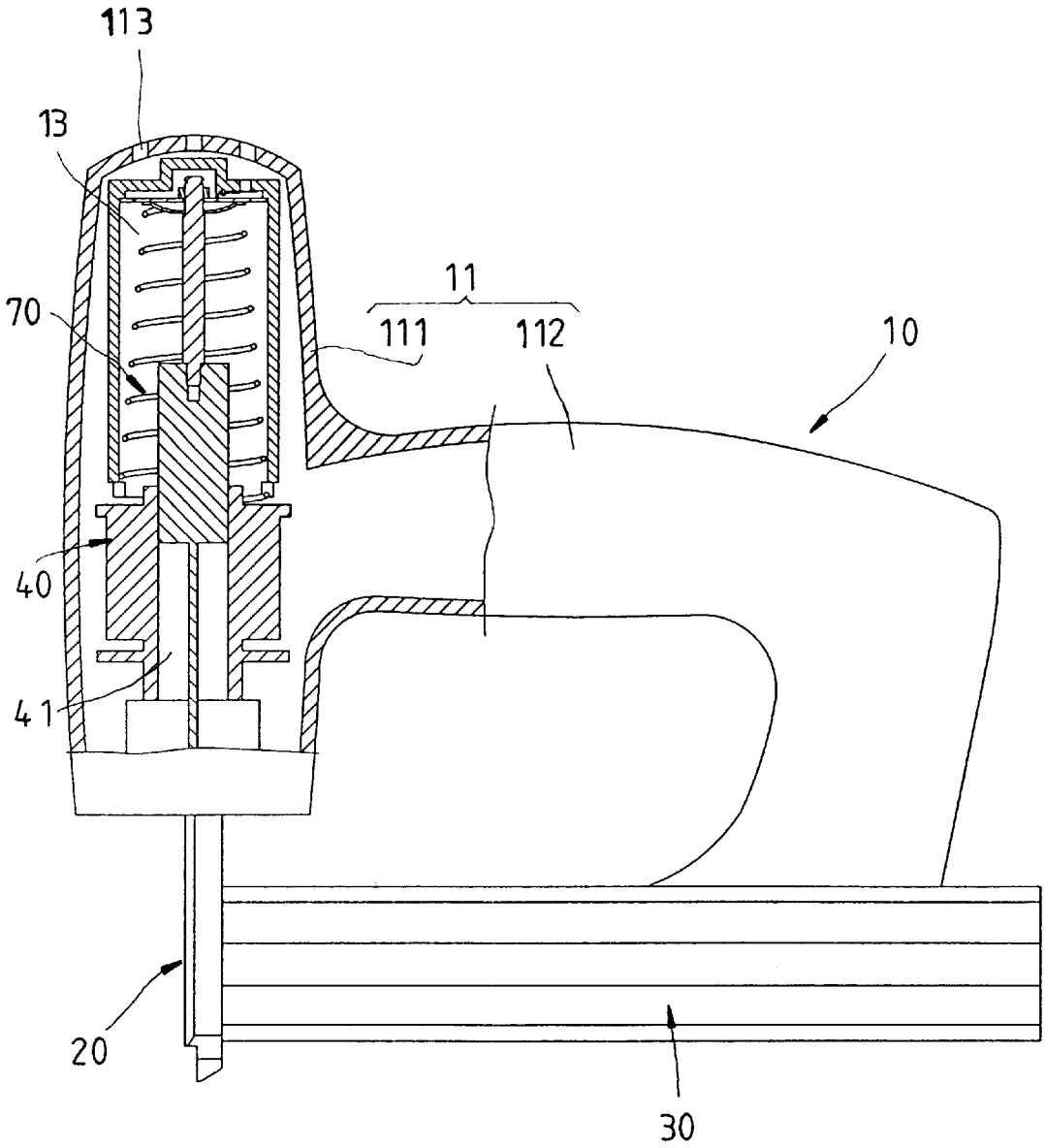
FIG. 4 is a sectional view in part of the preferred embodiment of the present invention.

Please refer to FIG. 3 to FIG. 4, the first preferred embodiment of the present invention provides a nailing gun 100, comprising a main body 10, a nail outlet 20, a nail magazine 30, a coil 40, a sealing member 50, a support member 60, a returning member, e.g. a spring 70, a bar 80, an adjusting member 90 and a pressing piece 95.

The main body 10 consists of a main housing 11 and a rear box 12. The main housing 11 has a head portion 111 and a handle 112, wherein the head portion 111 is provided with the nail outlet 20 at a front end thereof and holes 113 at a rear end thereof The rear box 12, a column-like element, is provided in the head portion 111 of the main housing 11 closing to the rear end thereof, which has a closed end 121 at an end thereof and an opening end 122 at the other end thereof The rear box 12 further has a chamber 13 therein and a through hole 14 at the closed end 121 communicating the chamber 13 with outside.

The coil 40 is mounted in the chamber 13 closing the nail outlet 20. The coil 40 has a central hole 41.

The sealing member 50 is made of flexible material, such as rubber, into a disk-like element, which has a masking face 51, a sealing edge 52 at an edge of the masking face 51 and a through hole 53 at a center of the masking face 51. The sealing member 50 is installed in the chamber 13 and the sealing edge 52 will be against an interior sidewall of the chamber when the masking face 51 is extended.

The support member 60 is a rigid disk which size is smaller than the sealing member 50. The support member 60 has a top ring 61, a concave portion 62 and a through hole 63, wherein the top ring 61 locates around the concave portion 62, the concave portion 62 orients the nail outlet 20 and the through hole 63 is provided at the concave portion 62.

The spring 70 is installed in between the support member 60 and the coil 40 which opposite ends rests against the top ring 61 and the coil 40 respectively, therefore, the top ring 61 is against the masking face 51 and the location of the top ring 61 against the sealing member 60 is at between the sealing edge 52 and the through hole 53.

Figure 5:
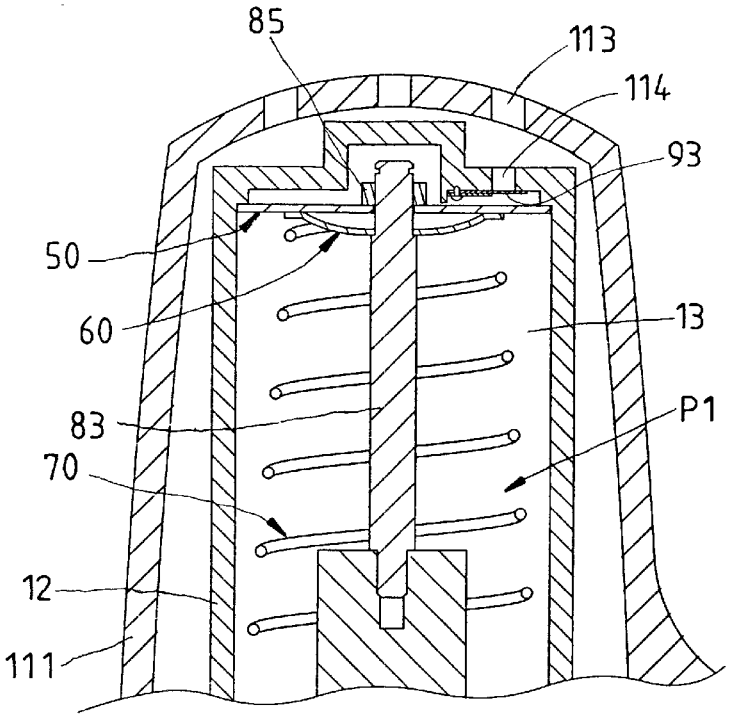
FIG. 5 is an enlarged view in part of FIG. 4.

The bar 80 has a head end 81, a punching section 82, a guiding section 83 and a tail end 84. The head end 81 passes through the central hole 41 and extended in to the nail outlet 82 for punching nail. The punching section 82 is received in the through holes 41 and the guiding section 83 is extruded out of the coil 40. Please refer to FIG. 3 and FIG. 5, the guiding section 83 of the bar 80 passes through the spring 70, the through hole 63 of the support member 60 and the through hole 53 of the support member 50. The bar 60 is provided with a stop portion 85 (such as a nut) to limited the sealing member 50 escaped form the bar 60. In addition, the bar 80 will be driven by the magnetic force provided by the coil to move between a stand-by position P1, as shown in FIG. 4, and a punching position P2, as shown in FIG.5. The spring 70 is to drive the bar 80 to the stand-by position P1 at initial.

The adjusting member 90 is a piece element which has a fixed end 91, a stop face 92 and an aperture 93. The adjusting member 90 is received in the rear side of the chamber 13 with the fixed end 91 thereof fixed to the interior sidewall of the main body 10, such that the stop face 92 will be suspended and shelters the through hole 14 of the main body 10. The aperture 93 locates at the stop face 91 corresponding to the through hole 14 and the size of the aperture 93 is smaller than the through hole 14.

The pressing piece 95 is more flexible than the adjusting member 90 having a first end 951 and a second end 952. The pressing piece 95 fixes the first end 951 thereof to the interior sidewall of the main body 10 and rests the second end 952 against the masking face 92 of the adjusting member 90 to make the sheltering the through hole 14 of the rear box 12.

FIG. 4 and FIG. 5 show the nailing gun of the present invention in stand-by condition, wherein the bar 80 locates at the stand-by position P1, the spring 70 is uncompressed and the pressing piece 95 is pushing the adjusting member 90 to shelter the through hole 14.

Figure 6:
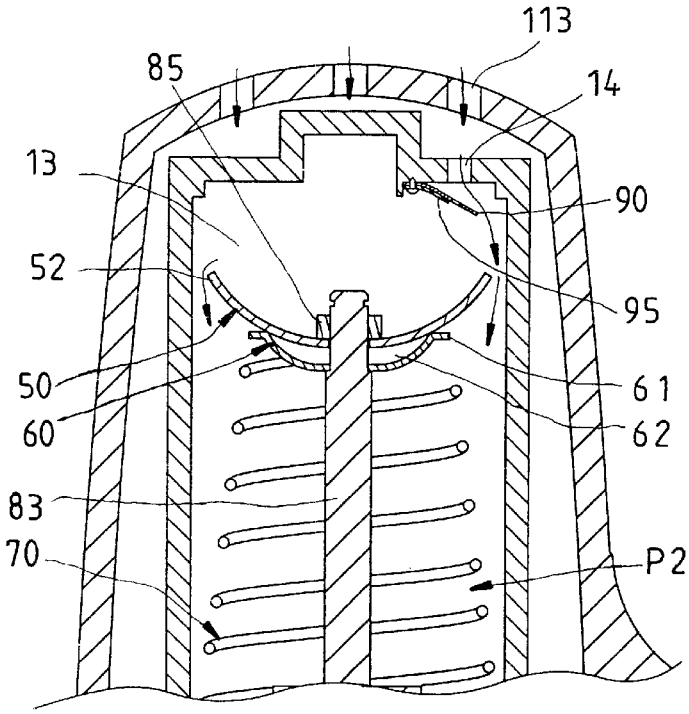
FIG. 6 is a sectional view similar to FIG. 5, showing the bar punching a nail.

FIG. 6 shows the pushing condition, the coil 40 is electrified and generating magnetic force to drive the bar 80 rapidly moving to the punching position P2. In the beginning of the bar 80 moving, a vacuum force will applied to make the pressing piece 95 biasing and unsheltered the through hole 14. In the mean time, the sealing member 50 will be curved by the top ring 61 of the support member 60 to make the edge of the sealing member 50 not against the sidewall of the chamber 13 anymore, such that air will be sucked into the chamber 13 via the holes 113 and the through hole 14 to make the bar 80 can move without any interference.

In the interval of bar moving back from the punching position P2 to the stand-by position P1, as shown in FIG. 5, the sealing member will be against the sidewall of the chamber 13 and the pressing piece 95 will shelter the through hole 14 again. Air only can escape from the chamber 13 via the aperture 93, such that the bar is buffered by the air.

The air flow in and out the chamber 13 can buffer the bar 80 when it is moving back from the punching position P2 to the stand-by position P1 but no interference will be applied when the bar 80 moves from the stand-by position P1 to the punching position P2, except that the air flow also can convect the heat generating by the coil 14 out of the chamber 13.

What is claimed is:

1. A buffer apparatus of a nailing gun, wherein the nailing gun includes a main body having a nail outlet and a chamber therein communicated with the nail outlet, a coil with a central hole provided in said chamber and a bar movably provided in the chamber which passes through said central hole of said coil and corresponds to said nail outlet, said buffer apparatus comprising:

a through hole provided in said main body and communicating said chamber to outside;

a sealing member, which is a flexible piece, provided in said chamber of said main body and secured to said bar, wherein said sealing member has a masking face and a sealing edge to be against a sidewall of said chamber when said masking face is extended;

a returning member provided at between said sealing member and said coil; and an adjusting member provided in said chamber of said main body and having a stop face and an aperture, wherein said adjusting member has an end thereof pivoted on the sidewall of said chamber to make said stop face sheltered and unsheltered said through hole and said aperture corresponds to said through hole which has a size smaller than said through hole.

2. The buffer apparatus of the nailing gun as defined in claim 1, further comprising a support member provided at between said coil and said sealing member having a top ring, a concave portion and a through hole, wherein said top ring is against said masking face of said sealing member, said concave portion orients a front end of said main body and said through hole is provided on said concave portion.

3. The buffer apparatus of the nailing gun as defined in claim 2, wherein said returning member is a spring installed to said bar having an end thereof against said coil and the other end thereof against said support member.

4. The buffer apparatus of the nailing gun as defined in claim 3, further comprising a pressing piece, which an end is fixed on a side wall of said main body at a rear side thereof and the other end is against said stop face of said adjusting member to make it sheltering said through hole.

5. The buffer apparatus of the nailing gun as defined in claim 4, wherein said sealing member is provided with a through hole at center for said bar passing through and prevent said bar escaping.

6. The buffer apparatus of the nailing gun as defined in claim 1, wherein said support member is a rigid body with said top ring extended from an edge of said concave portion and said sealing member is made of rubber.

7. The buffer apparatus of the nailing gun as defined in claim 1, wherein said chamber is round in cross-section and said sealing member and said support member are round disk-like elements which the size of said sealing member is larger than said support member and they are parallel to said chamber.

* * * * *